United States Patent [19]

Grau et al.

[11] 4,041,685

[45] Aug. 16, 1977

[54] PROCESS AND APPARATUS FOR REATTACHMENT OF A THREAD IN AN OPEN-END SPINNING MACHINE

[75] Inventors: Gerhard Grau, Albershausen; Otto Mayer, Ebersbach, both of Germany

[73] Assignee: Zinser Textilmaschinen GmbH, Ebersbach, Germany

[21] Appl. No.: 524,874

[22] Filed: Nov. 18, 1974

[30] Foreign Application Priority Data

Nov. 16, 1973 Germany ..... 2357223

[51] Int. Cl.[2] ..... D01H 15/00; D01H 1/12

[52] U.S. Cl. ..... 57/34 R; 57/58.95; 57/156

[58] Field of Search ..... 57/34 R, 58.89–58.95, 57/80, 81, 156

[56] References Cited

U.S. PATENT DOCUMENTS

| | | | |
|---|---|---|---|
| 3,540,201 | 11/1970 | Susami et al. | 57/80 |
| 3,601,969 | 8/1971 | Susami et al. | 57/58.91 |
| 3,670,484 | 6/1972 | Brazda et al. | 57/34 R |
| 3,680,300 | 8/1972 | Landwehrkamp | 57/34 R |
| 3,685,267 | 8/1972 | Landwehrkamp et al. | 57/34 R |
| 3,782,089 | 1/1974 | Landwehrkamp | 57/34 R |
| 3,803,823 | 4/1974 | Niestroj et al. | 57/34 R |
| 3,821,878 | 7/1974 | Parsons | 57/34 R |

*Primary Examiner*—John Petrakes
*Attorney, Agent, or Firm*—Edwin E. Greigg

[57] ABSTRACT

A process and apparatus for repairing thread breakage occurring in an open-end spinning machine which includes a spinning rotor, a pair of draw rollers, a thread tension sensor and thread windup spindles. The end of the thread to be reattached to fibers located within the spinning rotor is guided back from the windup spindle in such a way as to bypass the drawoff rollers and avoid being pinched thereby. The thread is passed alongside one of the draw rollers, preferably on a specially configured conical surface which facilitates eventual reinsertion between the two draw rollers.

The drive of the windup spindle is restarted by the tension sensor when it detects the reattachment of the end of the thread to the fibers in the spinning rotor as manifested by the increased tension in the thread. The increased tension pulls the thread between the drawoff rollers which transport it to the windup spindle at normal operating speed.

7 Claims, 3 Drawing Figures

PROCESS AND APPARATUS FOR REATTACHMENT OF A THREAD IN AN OPEN-END SPINNING MACHINE

BACKGROUND OF THE INVENTION

The invention relates to a process for the reattachment of a thread in an open-end spinning machine having at least one spinning motor. For this purpose, a thread is introduced into the rotating spinning rotor where it attaches itself to a ring of fibers located in the fiber collection groove of the spinning rotor. Subsequently, the thread is drawn out of the spinning rotor and is wound up on a driven windup spindle. A pair of drawoff rollers is provided between the spinning rotor and the windup spindle. The invention further relates to an apparatus for carrying out this process.

When it is intended to attach, i.e., re-spin a thread, in an open-end spinning machine having spinning rotors, for example when a thread breakage has occurred, the end of the thread must be guided back from the spindle into the spinning rotor. There it is attached to the fiber ring located in the rotating spinning rotor. From the moment that the end of the thread combines with the fiber ring, the thread is twisted and can be continuously drawn off so that a new thread is continuously formed from fibers pulled out of the fiber collection groove. In known manner, the fibers are guided pneumatically and continuously to the fiber collection groove. It is important that, in each instance of a new re-spinning of a thread to the fibers located within the spinning rotor, the pullout of thread from the spinning rotor takes place at a point in time when the thread end combines with the fiber ring located in the spinning rotor, because otherwise, excessive twisting of the thread, i.e., imparting too many rotations per unit length, would break the thread and this would lead to a failure of the re-spinning process and a new re-spinning attempt would be required.

When the end of the thread fed into the spinning rotor for the purpose of re-spinning is dragged along and shares the rotation of the spinning rotor, it undergoes a sudden increase of tension and simultaneously, the end of the thread is twisted onto the fibers deposited in the fiber collection groove of the spinning rotor and the thread breakage is thereby relieved. According to the present invention, this increase of the tensile stress in the thread is used as a signal for beginning to draw the thread out of the spinning rotor.

It has been shown that the attachment, i.e., the re-spinning of threads onto spinning rotors which run at very high rpm, for example, at 60,000 rpm and higher, is very difficult. In such cases, if the drawoff of the thread does not begin immediately after the attachment, i.e., after twisting the thread onto the fiber ring, then the thread is twisted off and broken in a very short time and the re-spinning attempt must then be repeated. This can be easily understood if it is realized that when the rotor turns at 60,000 rpm, in only half a second it imparts 500 rotations to a stationary and already twisted piece of thread which has a length of only approximately 10 cm as between the fiber collection groove and the thread guiding members which prevent further twisting. This comes to approximately 5,000 twists per meter of thread length which would be sufficient to twist off and break even fine threads. On the other hand, if the thread is drawn off too early, i.e., before the end of the thread guided into the spinning rotor has been twisted onto the fiber ring located therein, the attachment process has effectively failed also.

The period of time which elapses between sensing the increase of the tensile force in the thread due to its sharing the rotation of the spinning rotor and the time when the thread is already twisted too much is too short for a purely manual re-spinning operation when rotor speeds of approximately 60,000 rpm are used, i.e., the time which is available to an operator for sensing the increase of the tensile force in a piece of thread guided into the rotor and for the initiation of the drawoff process of that thread is too short: the thread is twisted off and breaks before the operator can react to the increase of the tensile force and can initiate the drawoff of the thread. Therefore, until the present time, it has been necessary to reduce the operating speed of the machine when a thread was being reattached. However, this is cumbersome, requires a separate apparatus (German Offenlegungsschrift No. 2,314,473) and results in a reduction of the productive capacity of the machine.

OBJECT AND SUMMARY OF THE INVENTION

It is a principal object of the invention to provide a process which makes it possible to attach, i.e., re-spin threads in open-end spinning machines even at very high speeds of the spinning rotor.

This object is attained, according to the invention, by providing that while the thread to be re-spun is introduced into the spinning rotor, it is kept away from the contact line or pinch line of the draw roller pair by being held at the axial, or end face of a draw roller. In addition, means are provided for sensing the increase of the thread tension which is produced when the end of the thread introduced into the spinning rotor shares the motion of the rotating spinning rotor. It is further provided that, subsequent to sensing the increase of the thread tension, the windup spindle is rotated in the windup direction and that the thread tension between the spinning rotor and the windup spindle causes the thread to be guided to the pinch line between the driven pair of draw rollers. Hence, the thread introduced into the spinning rotor is drawn out as soon as the end of the thread has been twisted onto the fibers deposited in the spinning rotor. The fact that the thread is not drawn off sooner prevents thread attachment failures. On the other hand, the removal of thread is begun immediately after the thread has been twisted onto the fibers located in the spinning rotor, preventing excessive twisting and breakage of the thread. This doubly effective control of the point when drawoff of the thread is begun can be achieved by using and embodying according to the invention only elements which are either already present or only simple supplementary elements.

The apparatus for carrying out the process according to the invention includes a thread guide, located between the spinning rotor and the draw roller pair. This thread guide, the draw roller pair and the windup spindle are so disposed that a thread which is fed back from the windup spindle to the thread guide lies up against an end face of one of the draw rollers so that it is displaced with respect to its location in normal operation. The apparatus further includes means for sensing the increased thread tension due to the fact that the end of the thread is carried along with and shares the rotational motion of the spinning rotor, and it triggers the start of the windup spindle.

A preferred further development of the invention provides that the pinch line of the draw roller pair lies at a certain distance from the plane defined by the thread guide and the thread guiding surface of the displacement roller. This distance is such that the thread to be reattached which is guided back into the thread draw out channel associated with the spinning rotor but which has not yet been reattached lies at some distance from one of the draw rollers whereas it lies up against the end surface of the other draw roller.

A further advantageous embodiment of the invention provides that the rim of the pressure roller is conical at least in the region in which the thread lies. This arrangement assures in a simple manner that the thread cannot be damaged by touching or wrapping itself around sharp corners of the rim of the pressure roller. Furthermore, it facilitates the movement of the thread to the pinch line of the draw roller pair. As has already been mentioned above, the thread tension sensor causes the thread windup spindle to be started when it senses an increase of the thread tension due to the fact that the end of the thread delivered to the spinning rotor shares in the rotation thereof. This can be done, for example, by locking the windup spindle at first in a position such that it is lifted off from the drive roller embodied as a friction roller.

When a signal is received from the thread tension sensor, the lock is released, and the windup spindle is lowered onto the driving roller. In another embodiment, the drive means for the windup spindle is lowered onto the driving roller. In another embodiment, the drive means for the windup spindle can include a switching clutch which is actuatable by the thread tension sensor. The elements which guide the thread are to be so disposed that the thread which lies up against an end face of one of the draw rollers is not pulled into the pinch line of the pair of draw rollers under the influence of the slight tensile force due to the air stream flowing into the spinning chamber, i.e., into the spinning rotor, through the thread drawoff aperture in the spinning member. Rather, it is intended that this displacement occur only as a consequence of the greater tensile force in the thread which is produced when the end of the thread shares in the rotation of the spinning rotor.

The most important parameters which influence these effects are, among others, the magnitude of the two above-mentioned tensile forces in the thread, the degree of deviation of the thread when it lies against an end face of the rim, the position of the secant with which the thread lies up against the flange and whether the thread touches or does not touch the circumferential surface of one of the draw rollers. The position the members guiding the thread must have for achieving the desired effect can be determined with no difficulty by test arrangements made for each individual case. It has been shown to be particularly advantageous if the angle by which the thread is laterally deviated by attachment to an end face of one of the draw rollers is 10° to 45° and preferably 25° to 35°.

The invention will be better understood as well as further objects and advantages will become more apparent from the ensuing detailed specification of preferred although exemplary embodiments taken in conjunction with the drawing.

DESCRIPTION OF THE PREFERRED EMBODIMENTS

Figure 1:
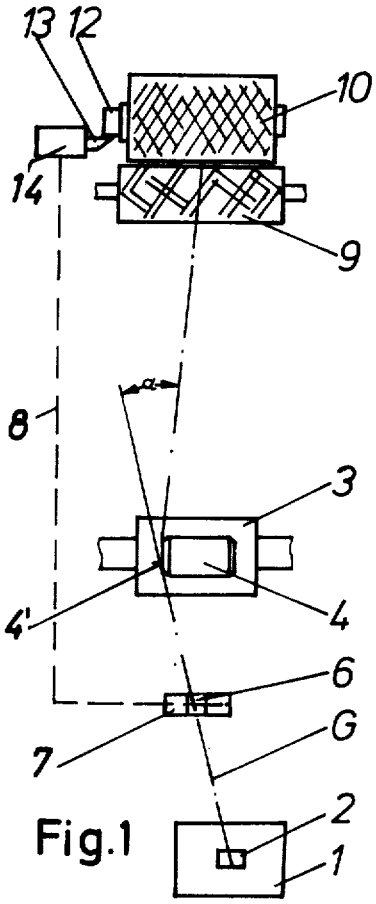
FIG. 1 is a schematic representation of an exemplary embodiment of an apparatus for re-spinning a thread onto an open end spinning machine, in a front elevational view.
Figure 2:
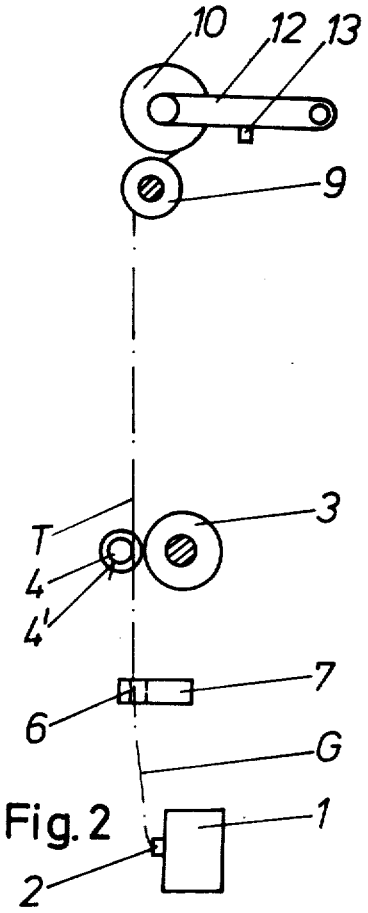
FIG. 2 is a side view of the apparatus according to FIG. 1 in the position it occupies after the occurrence of a thread breakage, when the windup spindle is lifted up and the end of the thread has already been guided back into the spinning box but has not yet been attached to the fiber ring within the spinning rotor.

FIGS. 1 and 2 show a single spinning box 1 of an open-end spinning machine which is equipped with a plurality of spinning boxes of this type. The spinning box 1 may be of any known kind. In a typical embodiment, the spinning box 1 has a device for supplying and spreading the fibers which are delivered to the spinning rotor located within the spinning box and which are twisted and drawn out as a thread G at a predetermined drawoff rate from a thread exit aperture 2 within the spinning box 1. The thread exit aperture 2 can in general be the outlet termination of a thread drawoff channel which is either stationary or is connected to the spinning rotor and whose longitudinal axis coincides with the rotational axis of the spinning rotor.

The thread is drawn out by a pair of draw rollers consisting of a constantly driven draw roller 3 and a draw roller 4, pressed against it. One of the draw rollers (in the example shown it is the draw roller 4), has a free end face 4'. This draw roller 4 can be mounted at each end in bearings but may only have one bearing, i.e., may be mounted in "flying" manner. The end face 4' of the draw roller 4 is preferably frusto-conical. Each thread G is guided via one thread guide 6 and one thread tension sensor 7 disposed between the spinning box 1 and the draw roller pair 3,4. The thread guide 6 and the thread tension sensor 7 can be combined in one member as shown or may be disposed separately. From the drawoff roller pair 3, 4, the threads G travel to a driven windup spindle and is wound up thereon. The windup spindle 10 rests on top of a customary, drive distribution roller 9, for example a grooved roller, and is driven thereby. The windup spindle 10 is rotatably mounted on a pivotable arm 12 and presses against the distribution roller 9 due to its own weight. The windup spindle 10 can be held in a position in which it is lifted off from the distribution roller 9 by an operable latch 13 which engages the arm 12. The latch 13 is actuated by the thread tension sensor 7 in such a way that the latch 13 is pulled back and, thus, the windup spindle 10 is lowered onto the distribution roller 9 whenever the thread tension, as sensed by the thread tension sensor, exceeds a predetermined and adjustable value. The actuation of the latch 13 can be preferably take place electrically through a line 8 by closure of a contact within the thread tension sensor 7, causing a current to flow through an electromagnet 14 which pulls back the latch 13.

The spatial association of the thread guide 6, the thread tension sensor 7, the draw rollers 3 and 4 as well as the distribution roller 9 is such that the thread G guided over these elements and lying up against the free end surface 4' of the draw roller 4 is deviated both at the thread tension sensor 7 as well as at the draw roller 4. The displacement at the thread tension sensor 7 tends to load the thread tension sensor and the displacement at the draw roller 4 tends to pull the thread between the draw rollers 3, 4.

Figure 3:
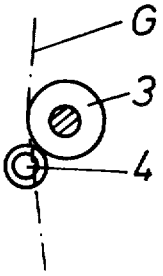
FIG. 3 is another embodiment of the draw roller pair of the apparatus according to FIG. 2.

According to the disposition of FIG. 2, the draw rollers 3,4 are so located that the thread which runs in a straight line from the thread guide 6 to the distribution roller 9 is displaced from the center in a direction opposite to draw roller 3 and lies up against the end face 4' of the draw roller 4. FIG. 3 shows the draw rollers 3 and 4 so disposed that the thread G which has not yet been reattached lies up against the circumferential surface of the draw roller 3 as well as against the end face of the draw roller 4.

The re-spinning or reattachment of a thread will now be explained with the aid of FIGS. 1 and 2.

In the exemplary embodiment shown in these figures the wound-up thread package located on the windup spindle 10 had almost attained its final diameter because, even in the lifted-off position, the windup spindle is located at a relatively small distance from the distribution roller 9. However, the repair of a thread breakage can take place at any diameter of the thread winding package, even if the windup spindle 10 is still empty. In the latter case, a thread is wound around the windup spindle 10 several times so that it can no longer slide on the windup spindle 10. In both cases, the free end of the thread is guided, by hand or, if necessary, by automatic means, into the exit aperture 2 of the spinning box 1 for the purpose of re-spinning the thread. The thread is brought into the path seen in FIGS. 1 and 2, between the windup spindle 10 and the thread guide 6, where it lies up against the end face 4' of the draw roller 4 which is pressed against the driven draw roller 3, and thence passes through the thread guide 6 to the spinning box 1. In such a spinning box 1 of an open-end spinning machine, at least when the spinning rotor is turning, an air stream always flows from the outside into the thread drawoff channel and through it into the interior of the spinning rotor. Thus, it is sufficient, at least in most cases, to insert the thread end to be reattached into the thread drawoff channel of the spinning box or to bring it so near that it is carried along by the air stream flowing through the thread drawoff channel and is thereby introduced into the interior volume of the rotating spinning rotor. When the reattachment takes place, the fiber collection groove of the spinning rotor contains fibers. The fibers are introduced pneumatically, in known manner, through a fiber supply channel, to the interior volume of the spinning rotor. It can be suitably provided that the supply of fibers into the spinning rotor is interrupted after the occurrence of a thread breakage, and it is re-started only when the thread tension sensor senses the presence of tension in the thread inserted into the spinning rotor. This occurs when the free end of the thread is carried along by and shares the motion of the rotating spinning rotor which means that the thread is now attached to the fibers located in the fiber collection groove and thus is twisted onto them. The centrifugal forces occurring in this process increase the tensile force in the thread and the thread tension sensor 7 senses this increase of the thread tension and closes an electrical contact or a switch by which the electromagnet 14 is excited via line 8 so that the electromagnet 14 pulls back the latch 13, lowering the winding spindle 10 and its thread package onto the distribution roller 9. From this point on, the distribution roller 9 drives the windup spindle 10 in the proper direction for winding up the thread G. This increases the thread tension as between the spinning box 1 and the windup spindle 10 in such a way that the thread G is pulled away from the end face 4' of the draw roller 4 and moves between the two draw rollers 3, 4 where it is pinched. This insertion of the thread into the pinch line of the draw roller pair 3,4 is facilitated by the frusto-conical shape of the end surface 4'. The base of the frustoconical surface is preferably immediately adjacent to the cylindrical surface of the draw roller 4. As soon as the thread has reached the pinch line of the draw roller pair 3, 4, its speed of advance is determined exclusively by the speed of this draw roller pair 3, 4. Due to the steady supply of fibers into the fiber collection groove of the spinning rotor, new fibers are constantly deposited on the thread located in the spinning rotor and, thus, thread is continuously being spun and is continuously being wound up on the windup spindle 10.

If another thread breakage occurs or if the windup spindle 10 is exchanged for a new, empty windup spindle, the re-spinning or reattachment process described above is repeated. It should be mentioned that, prior to each re-spinning process, the windup spindle 10 is lifted off from the distribution roller 9 and the latch 13 is brought into the right-most position as shown in FIG. 1 in which it holds the windup spindle 10 up so that the thread package does not come in contact with the distribution roller 9. The lifting of the windup spindle 10 from the distribution roller 9 and the movement of the latch 13 into the position shown in FIG. 1 can be effected manually. The movement of the latch 13 into the position shown in FIG. 1 can also occur automatically or means can be provided for a completely automatic lifting of the windup spool 10. For example, instead of the linearly-moved latch 13, there could be provided a pivotable spring-loaded lever so that, when the current in line 8 is interrupted, associated spring means always guide the windup spindle 10 into a position in which it does not rest on the distribution roller 9. The interruption of current in line 8 can take place automatically, for example, by means of the thread tension sensor, whenever a thread breakage occurs so that, in this case, and after each thread breakage, the windup spindle 10 is automatically moved into its lifted-off position.

The angle $\alpha$, shown in FIG. 1, of the thread placed against the end face 4' of the draw roller 4 for the purpose of reattachment can suitably be 10° to 45°, and preferably 25° to 35°. Of course, its magnitude depends on the particular position which the thread G occupies on the windup spindle 10. In normal operation, i.e., during the normal thread drawoff by means of the draw roller pair 3, 4, the thread always remains on the pinch line between the draw roller pair 3, 4. The above explanations for reattaching and re-spinning the thread are also valid for the embodiment of the draw roller pair according to FIG. 3.

Inasmuch as the thread guided back into the spinning rotor is drawn off under the control of the thread tension sensor 7 and by means of the windup spindle 10 as soon as it has been twisted onto the fibers located in the fiber collection groove, a thread breakage due to an increased imparting of thread rotations is avoided. Pulling the thread out of the spinning rotor before it has been twisted onto the fibers located in the fiber collection groove of the spinning rotor is also prevented.

In the exemplary embodiment according to FIG. 1, the end face 4' of the draw roller 4 is embodied as a frustoconical element. However, the invention is not limited to such a form for this end surface 4'. For example, in many cases instead of the conical end-face region, an end surface or an end-surface region at right angles with respect to the rotational axis of the draw roller may be provided adjacent to the cylindrical surface of the roller 4. Even in this case, the thread can be pulled into the pinch line of the draw roller paid. Still different embodiments of the particular end surface are possible. Furthermore, it is also possible that the driven draw roller is so disposed and embodied that the thread may be laid against one of its own end surfaces during the re-spinning.

In the context of this invention, the term "end surface" of a draw roller to which the thread may attach, refers to any surface which is transverse to and/or inclined with respect to the rotational axis of the drawoff roller or which annularly envelops or contains the rotational axis, and which is suitable for holding the thread away from the pinch line of the draw roller pair until the thread moves over the pinch line of the draw roller pair due to the tensioning of the thread as a consequence of the start-up of the windup spindle 10. If necessary, therefore, it may be the sidewall of a groove or it may be a radial or at least substantially radial flange of the drawoff roller. The term "end surface" of the draw roller is therefore to be taken in its most encompassing sense and in no case is it limited to a surface at the end of the drawoff roller. Thus, for example, the driven drawoff roller is generally and suitably constituted by only a portion of a shaft extending along the spinning boxes, which is provided with a single section forming a drawoff roller in the vicinity of each spinning box.

As may be seen particularly well from FIG. 2, in this exemplary embodiment, the pinch line of the drawoff roller pair 3, 4 is far enough removed from the plane T defined by the thread guide 6 and the thread guide surface of the distribution roller 9 that the thread G which has not yet been pulled into the pinch line of the drawoff roller pair does not lie up against the driven drawoff roller 3 but only against the end surface 4' of the drawoff roller 4. Furthermore, this preferred exemplary embodiment provides that the driven drawoff roller 3 is disposed at some distance from this plane T. In the exemplary embodiment of FIG. 3, which is also a preferred exemplary embodiment, it is provided that the pinch line of the drawoff rollers 3, 4 is located at such a distance from a plane defined by the thread guide 6, (not shown here) and by the thread guiding surface of the distribution roller 9, (also not shown here) that the thread introduced into the spinning rotor for the purpose of re-spinning but which has not yet been pulled over the pinch line of the drawoff roller pair lies up against the outside surface of one drawoff roller 3 and up against the end surface of the other drawoff roller 4. In this exemplary embodiment, the drawoff roller to whose surfaces the thread attaches is the driven drawoff roller 3.

Preferably, all spinning rotors and drawoff roller pairs of the open-end spinning machine can be continuously power driven, even during the re-spinning, because the re-spinning process may be carried out without stopping the drawoff roller pairs and the spinning rotors. In addition, it is not necessary to reverse the rotational direction of the drawoff rollers for the purpose of re-spinning, rather they may continue to rotate in the same direction of rotation. However, the invention is not limited to this feature, because, in some cases, it may be provided that the drawoff rollers are stopped or reversed in direction during the return passage of the thread so that they themselves guide the thread back to the spinning box whereby means may be provided, for example, a controllable lever, which guides the thread out of the pinch line of the drawoff roller pair before it enters the spinning rotor and which lays it up against an end surface of one of the two drawoff rollers. However, since the invention makes it possible for the drawoff rollers to rotate continuously in the same direction of rotation even during the re-spinning, this technically and operationally particularly simple method is to be regarded as preferred.

What is claimed is:

1. In a process for attachment of threads within an open-end spinning machine with at least one spinning rotor, a windup spindle and a pair of draw rollers, disposed between said spinning rotor and said windup spindle, including the steps of introducing the thread into said spinning rotor; attaching the thread to said fibers located in said spinning rotor; and winding up the thread on said windup spindle, with the thread length between the spinning rotor and the windup spindle defining a thread path; the improvement comprising the steps of:

a. orienting the pair of draw rollers in the spinning machine relative to the windup spindle and the spinning rotor such that an end face of one of the draw rollers lies in a plane displaced relative to the thread path;

b. placing the thread in contact with said end face for maintaining it in a position wherein it does not lie on the line of contact between said pair of draw rollers and is misaligned relative to said thread path;

c. sensing the increase in tension in the thread which occurs when the thread inserted into said spinning rotor shares the rotary motion thereof; and d. initiating the rotary motion of the windup spindle in the winding up direction in response to said increase in tension; whereby the tension in the thread urges it to move onto the line of contact between said pair of draw rollers and into alignment with said thread path.

2. An apparatus for the attachment of threads within an open-end spinning machine comprising:

at least one spinning rotor;

a windup spindle associated with each spinning rotor;

a distribution means disposed between each spinning rotor and its associated windup spindle, the distribution means defining a thread guide traversing path along the axis of the windup spindle;

a thread guide disposed between each spinning rotor and its associated distribution means;

a pair of draw rollers disposed between each associated thread guide and distribution means, with an end face of at least one draw roller passing through a plane defined by the thread guide and the thread guide path of the distribution means so that a thread, which is run from the windup spindle along the thread guide traversing path of the distribution means through the thread guide and inserted into the spinning rotor for the purpose of attachment to fibers therein but which is not yet attached, lies against said at least one draw roller end face and defines a reverse path which deviates from the path that the thread would define during normal operation; and a thread tension sensing means, disposed between each spinning rotor and its associated windup spindle, for starting the thread windup spindle upon sensing an increase in the thread tension caused when the end of the thread inserted into the spinning rotor shares the rotary motion thereof;

whereafter further increase in tension between the spinning rotor and its associated windup causes the thread to be guided into a pinch line between the two draw rollers.

3. An apparatus as described in claim 2, wherein the pair of draw rollers is also disposed so that one draw roller and the pinch line between the draw rollers is at a distance from the plane defined by the thread guide and the thread guide traversing path of the distribution roller, and the thread inserted into the spinning rotor but not yet attached therein lies at a distance from the one draw roller against the end face of the other draw roller.

4. An apparatus as described in claim 2, wherein the pair of draw rollers is also disposed so that thread inserted into the spinning rotor but not yet attached therein lies against the outer surface of one draw roller and against the end face of the other draw roller.

5. An apparatus as described in claim 4, wherein the draw roller against whose outer surface the thread comes to lie during its insertion into the spinning rotor is the driven draw roller of the draw roller pair.

6. An apparatus as described in claim 2, wherein said at least one draw roller end face which serves to support the thread during its insertion into the spinning rotor is embodied so that it includes a conical portion at least in its thread engaging region.

7. An apparatus as described in claim 2, wherein the angle of deviation by which the thread is displaced by comparison to the normal path taken while spinning the thread during reverse delivery into the spinning rotor for the purpose of re-spinning and that path due to the thread lying against at least one draw roller end face is 10° - 45°, preferably 25° - 35°.

* * * * *